United States Patent [19]

Fragge et al.

[11] Patent Number: 4,951,493

[45] Date of Patent: Aug. 28, 1990

[54] METHOD AND APPARATUS FOR MAKING A SPIRAL PIPE

[75] Inventors: Hermann Fragge, Lohne; Ewald Westerkamp, Dinklage; Felix Willenborg, Kohne/Kroge, all of Fed. Rep. of Germany

[73] Assignee: Siekmann Fittings GmbH & Co. KG, Lohne, Fed. Rep. of Germany

[21] Appl. No.: 354,169

[22] Filed: May 19, 1989

[30] Foreign Application Priority Data

May 30, 1988 [DE] Fed. Rep. of Germany ..... 3818315
Jul. 4, 1988 [DE] Fed. Rep. of Germany ..... 3822541

[51] Int. Cl.[5] ..... B21C 37/15

[52] U.S. Cl. ..... 72/69; 72/77; 72/96

[58] Field of Search ..... 72/64, 141, 133, 97, 72/96, 77, 69

[56] References Cited

U.S. PATENT DOCUMENTS

| | | | |
|---|---|---|---|
| 1,973,687 | 9/1934 | Moise | 72/97 |
| 2,505,623 | 4/1950 | McLaughlin et al. | 72/141 |
| 2,936,019 | 5/1960 | Miller | 72/133 |
| 4,306,437 | 12/1981 | Javorik et al. | 72/96 |

*Primary Examiner*—Lowell A. Larson
*Attorney, Agent, or Firm*—Jordan and Hamburg

[57] ABSTRACT

In fabricating a spiral pipe, a pipe section is pressed in the direction of the pipe axis over an expansion mandrel in a press. The expansion mandrel is spirally curved at least in one end region and provides fast and precise shaping of spiral of any pitch. The method provides that the pipe section carries out relative rotation between the expansion mandrel and the pipe section about the pipe axis. An apparatus to implement the method provides that a press ram which is used to move the pipe section forward, and/or the expansion mandrel, are designed to provide relative rotation therebetween.

22 Claims, 8 Drawing Sheets

METHOD AND APPARATUS FOR MAKING A SPIRAL PIPE

BACKGROUND OF THE INVENTION

This invention relates to a method and apparatus for fabricating a spiral pipe. A method and apparatus for making a spiral pipe are known from U.S. Pat. No. 2,505,623. Spiral pipes with a slight curvature and/or moderate quality requirements can be fabricated by the known method and the associated apparatus. However, the known method fails for requirements that extend beyond this.

In actual practice, however, spiral pipes are frequently used for tasks which require stronger deformations and thus a high quality with regard to dimensional accuracy as well as with regard to the material structure, for example, as eccentric spirals for eccentric spiral pumps, as drive elements for well-drilling devices, and as elements for propeller pumps and propeller motors. Up to now, eccentric worms or screws, if they have not been turned or spun from solid material, have been welded together from sheet-metal half-shells, the shape of which is very complicated, or formed by repeatedly pressing and withdrawing a pipe into and from a conical die with flexibly mounted die parts.

SUMMARY OF THE INVENTION

It is an object of the invention, starting from a mandrel bending method of the type considered above, to provide a method for fabricating spiral pipes of high quality and arbitrary pitch in a continuous process, and in this connection to utilize the working speed and the practical experience associated in actual practice with the fabrication of pipe bends. Another object of the invention is to provide an apparatus for implementing such a method.

The inventive solution is based on the realization that a procedure of this type, which arises from the state of the art and also forms the basis for the basically similar method for fabricating pipe bends, generally does not lead to useful results because the pipe, on being shaped into a spiral, must carry out an axial movement as well as a rotary movement if torsions or irregular flow processes, which affect the quality of the product, are not to be absorbed. Only if the pipe section supplied executes a rotary motion relative to the mandrel in the direction of the spiral, is the quality of the spiral produced similar to that of pipe bends, which have bean fabricated by the pipe bending method.

The rotary motion of the pipe can be a free motion, if the mandrel is mounted so that it can rotate with respect to the pressing device and/or the compressing device or those parts of these devices, which contact the pipe. However, the mandrel and/or the pipe can also be subjected to a constrained motion, so that a coupling is established between the advance motion and the rotary motion.

The apparatus implements by way of equipment what the method intends. On one side the spreading mandrel and on the other side the press ram are put into a relationship to one another in order to achieve the desired rotary mobility. It is, of course, sufficient if the bearing, which is provided to press against the rearward end of the pipe, is rotatable, while the mobility of the press ram can be restricted to a purely axial motion.

With this method and this apparatus, the production of spiral pipes for eccentric pumps, for example, becomes astonishingly simple. A straight pipe section, which can consist of a seamless or a welded pipe section, is forced cold or also heated to the deformation temperature over a mandrel coiled helically in the given geometry and leaves this mandrel with precise surface dimensions as well as with a perfect interior surface structure and a perfect exterior surface structure. The pipe section can advantageously be heated in a fashion that has already established itself with the bending of pipe sections, i.e. by heating with burner flames from a ring nozzle, which heats the pipe precisely where it passes the mandrel, or by induction heating in this particular area.

It has been ascertained that shaping by a mandrel achieves a precision, which generally does not require any supervision or assisting intervention and which makes even touch-up work superfluous.

The drawings show several embodiments of the object of the invention, and these embodiments are described in more detail below.

DESCRIPTION OF THE PREFERRED EMBODIMENTS

Figure 1:
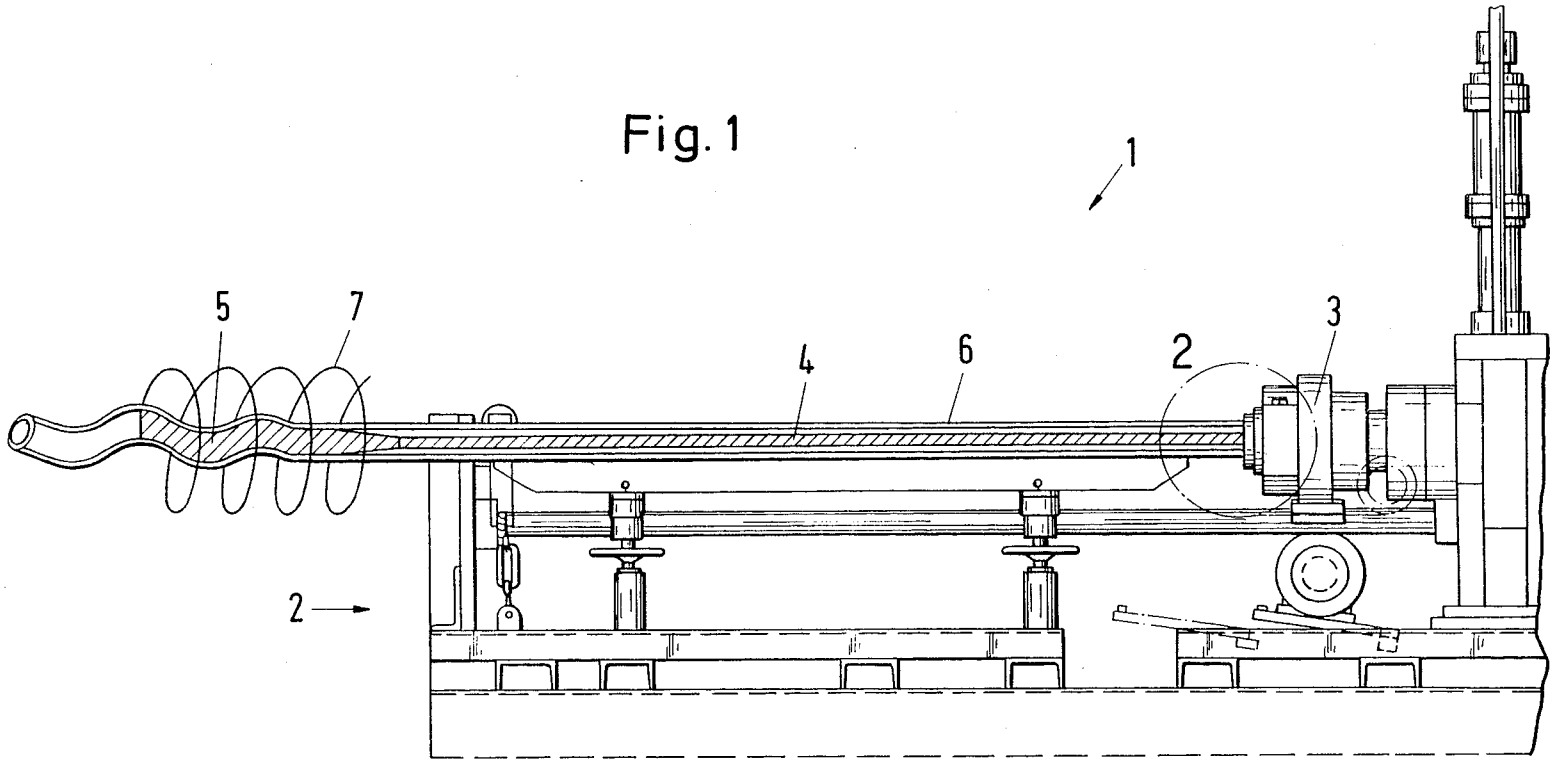
FIG. 1 shows a side view of an apparatus of the invention.

In FIG. 1, the apparatus for shaping pipes, which is labeled 1 as a whole, has in the manner wall known for fabricating pipe bends a press frame 2 with various facilities for making adjustments and supporting dies. A press ram 3 can be moved forward alongside a shaft 4, which is passed through the press ram 3 and anchored in the frame, in the direction of a mandrel 5 with pressing forces up to the order of about 1000 tons. The press ram 3 presses against a face of a pipe section 6 (or also several pipe sections sequentially strung on the shaft 4), in order to move this pipe section 6 over the mandrel 5.

The mandrel 5 has a complex shape, which basically causes the pipe to be expanded and to be shaped in the form of a spiral. At the same time, influence can be exerted by the shape of the mandrel on the flow of the material in the circumferential direction and thus the distribution of wall thickness in the pipe wall. By shaping the mandrel so as to cause an overlapping of deformations in the sense of an expansion, a helical curvature, and a change in wall thickness, a person skilled in the art can create a precision die, which produces a uniformly coiled pipe and does so moreover in a single working step.

In simple cases, for instance with thin-walled pipes or easily deformable material, the pipe can be deformed cold. However, pipes of higher strength or with thicker walls are generally deformed hot. In the present case, an induction coil 7 about the mandrel 5 is provided for this purpose. This induction coil 7 always heats the pipe 6 as it traverses the deformation region.

Figure 2:
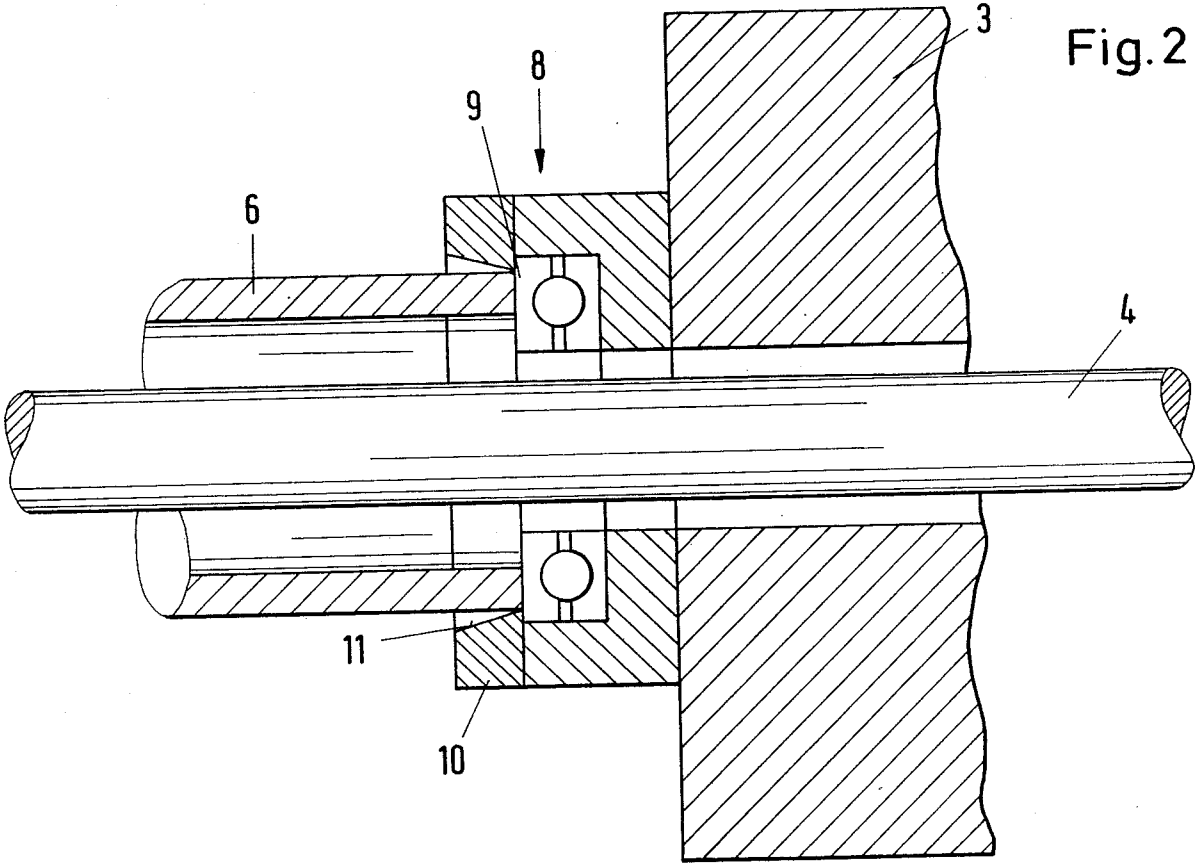
FIG. 2 shows the detail II from FIG. 1 in an enlarged sectional representation.

The interior of the pipe adapts itself to the spiral shape of the expansion mandrel 5; the end of the pipe executes not only moves forward but also rotates. Advisably, provisions are made so that the pipe 6 supplied also turns with respect to the shaft 4, so that the pipe will not also be subjected to torsional deformations during the shaping process. As can be seen from the enlarged sectional representation of FIG. 2, the press ram 3 encloses the shaft 4. As a rule, these press parts cannot rotate with respect to one another, but can move only axially. They see to it that the pipe 6 can be held alongside the shaft 4 and moved by the press ram 3. The rotational mobility of the pipe 6 is brought about owing to the fact that a pivot bearing 8, which presses with a thrust collar that runs in ball bearings against the and face of pipe 6, is connected in series with the press ram 3. At the same time, the pipe 6 is centered by a collar 10 with a conical inside surface 11.

Figure 3:
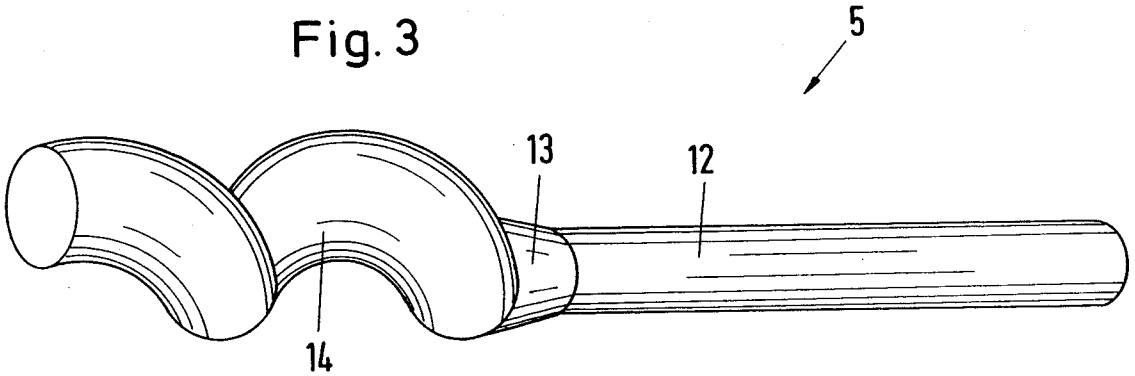
FIG. 3 shows the expansion mandrel of the invention in an oblique view.
Figure 4:
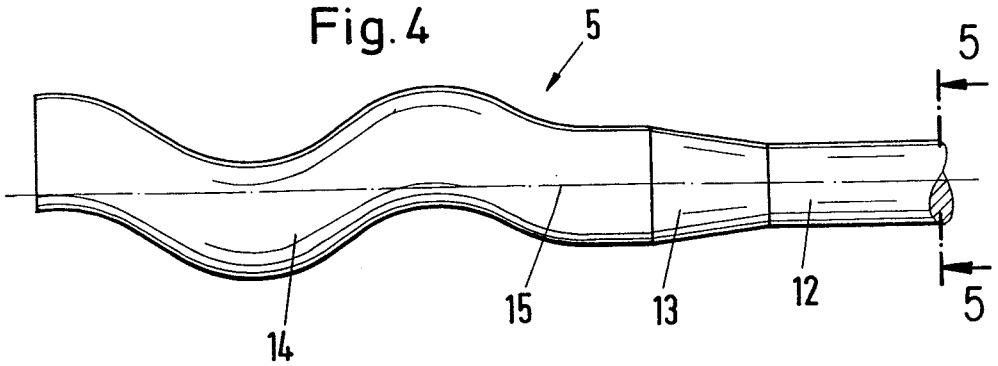
FIG. 4 shows a side view of the expansion mandrel of FIG. 3.
Figure 5:
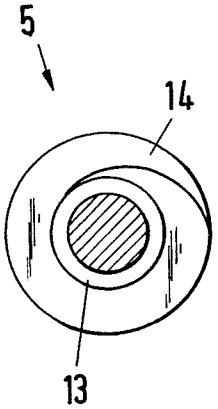
FIG. 5 shows a view of the mandrel of FIG. 4, along the line V—V.
Figure 7:
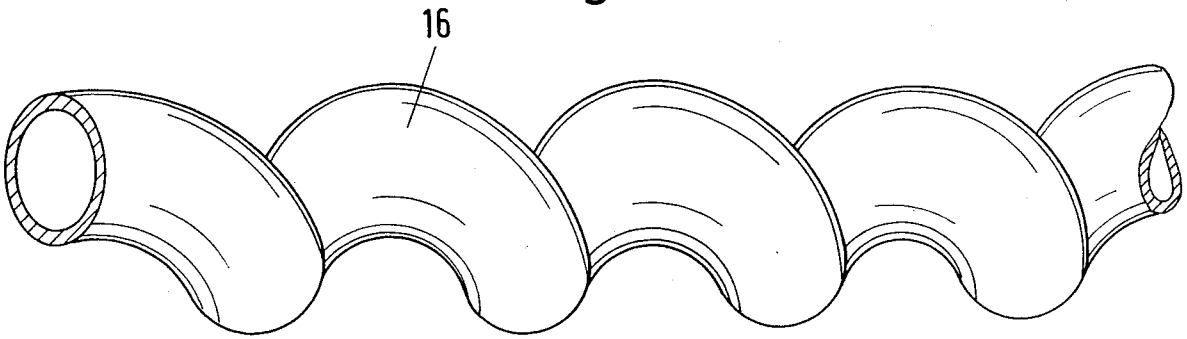
FIG. 7 shows an oblique view of the spiral pipe of FIG. 6.

It can be seen from the oblique view of FIG. 3 that the mandrel 5 can be divided into different sections in the longitudinal direction. First of all, a section with a smaller diameter is intended to bring about the connection with the shaft 4, and to achieve on the outside a longitudinal guidance with respect to the pipe that is being shaped. Such a guidance zone 12 of the mandrel is followed by a comparatively short expansion zone 13, in which a pipe, forced over the mandrel, experiences the major portIon of its deformation. As mentioned above, not only an expansion, but also a coil-shaped curved deformation and a flow of the material in the circumferential direction so as to influence the wall thickness can take place at the same time. The expansion zone 13 is followed by a sizing zone 14, in which the mandrel, with essentially a constant cross section and constant spiral curvature, undertakes a fine adjustment sizing of the pipe and, at the same time, during the expansion process, also undertakes an alignment of the pipe that reacts on the expansion zone. FIGS. 4 and 5 clarify the zones described above in a side view and an axial view respectively. As FIGS. 4 and 5 show, the mandrel has associated with it a longitudinal axis which represents a cylinder axis in the guidance zone 12, but continues as a screw axis in the sizing zone 14. This axis, labeled 15, always runs within the mandrel in the present embodiment.

Figure 6:
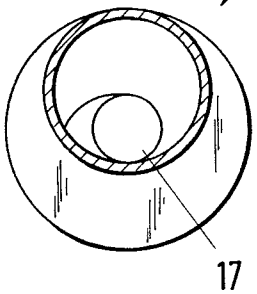
FIG. 6 shows an axial view of a spiral pipe, fabricated by the inventive method.

FIG. 6 shows that a pipe, fabricated with such a mandrel 5, has an outside circular contour which, in the case of eccentric pumps, can be assigned to a fitting inside cylinder, and that the resulting spiral pipe has a free lumen 17, shaped precisely even with long types of construction, within the pipe cross section, as a circle about the axis 15.

Figure 8:
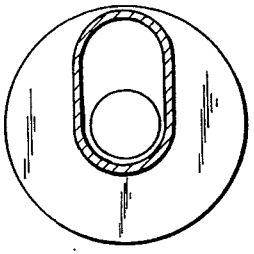
FIG. 8 shows an axial view of another spiral pipe with a cross section that has been changed to an oval shape.

It goes without saying that a very much more strongly coiled pipe can also be produced by the same method and with the same apparatus. In that case, a free lumen can then be observed outside the pipe cross section in an axial view. It furthermore goes without saying that, as far as manufacture is concerned, such spiral pipes need not be limited to ones of a circular cross section. Spiral pipes with triangular, rectangular, or polygonal cross sections or with other bent shapes, can readily be produced. FIG. 8 shows an embodiment with an oval cross section; such a pipe can also be produced in one working step without touch-up work.

The outstanding feature of this manufacturing method is precisely that it permits a pipe, coiled with high precision and generally requiring no touch-up work, to be shaped in one continuous operation, which requires comparatively little time and effort. This result is especially surprising if one considers the complex shaping processes that lead from the pipe-shaped semi-finished starting material to the finished spiral pipe, as the pipe passes over the mandrel. Aside from the skillful shaping of the mandrel, what is important here is that the pipe is caused to or allowed to rotate. As was seen especially from FIG. 2, the pipe may run on bearings so that it can rotate mounted with respect to the press ram 3. In a reversal of this arrangement, the shaft 4 and/or the mandrel may also run on bearings so that they can rotate; in this case, the pipe need not run on bearings. Aside from this, mandrel, and/or the shaft being freely rotatable, a driven and forcibly controlled rotary motion is produced between the pipe and the mandrel, either by connecting a rotationally driven doughnut disk plate in series with the press ram or by rotating the shaft in correspondence with the advance of the press ram.

Figure 9:
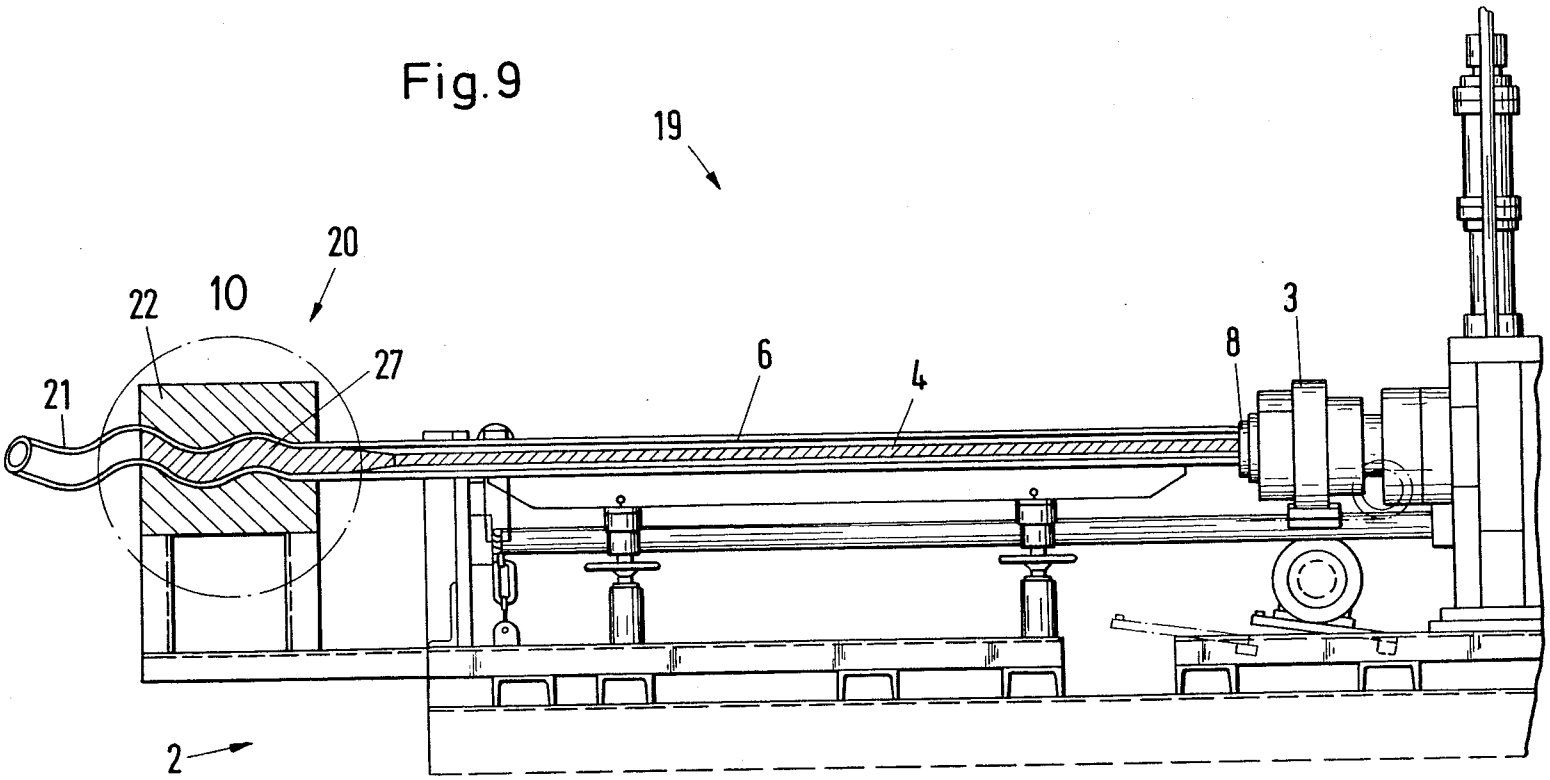
FIG. 9 shows a side view of an apparatus of the invention (partially in section), during the pressing of pipe sections into a spiral pipe.
Figure 10:
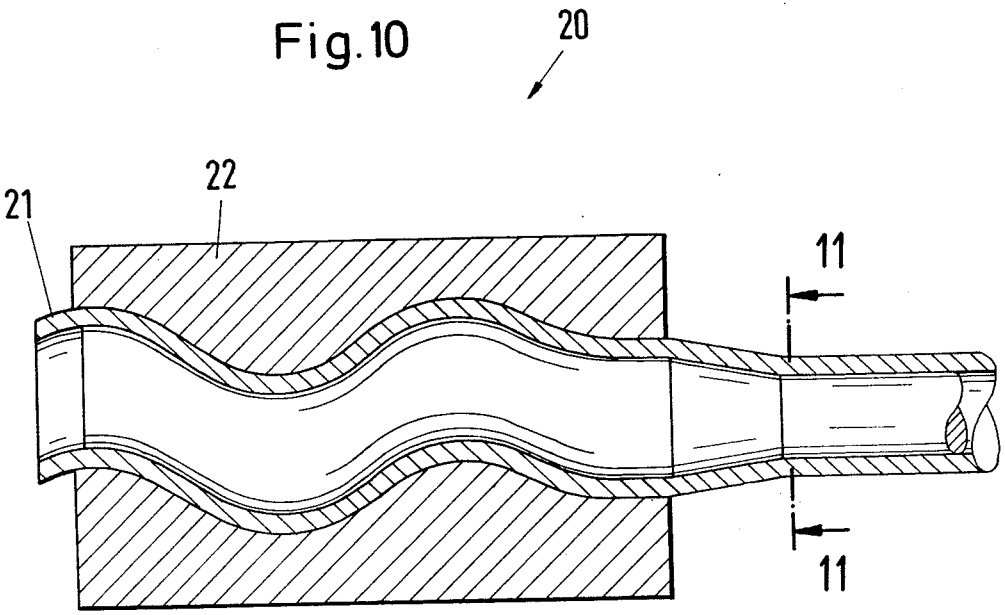
FIG. 10 shows an enlarged detail X of FIG. 9, namely a die with pipe or spiral pipe.
Figure 11:
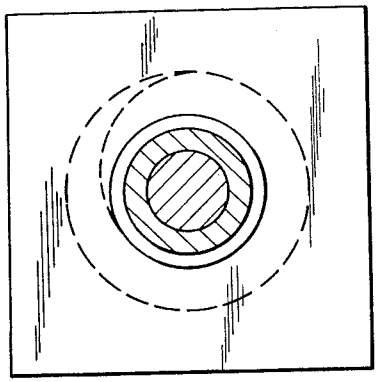
FIG. 11 shows a section along line XI—XI in FIG. 10.
Figure 12:
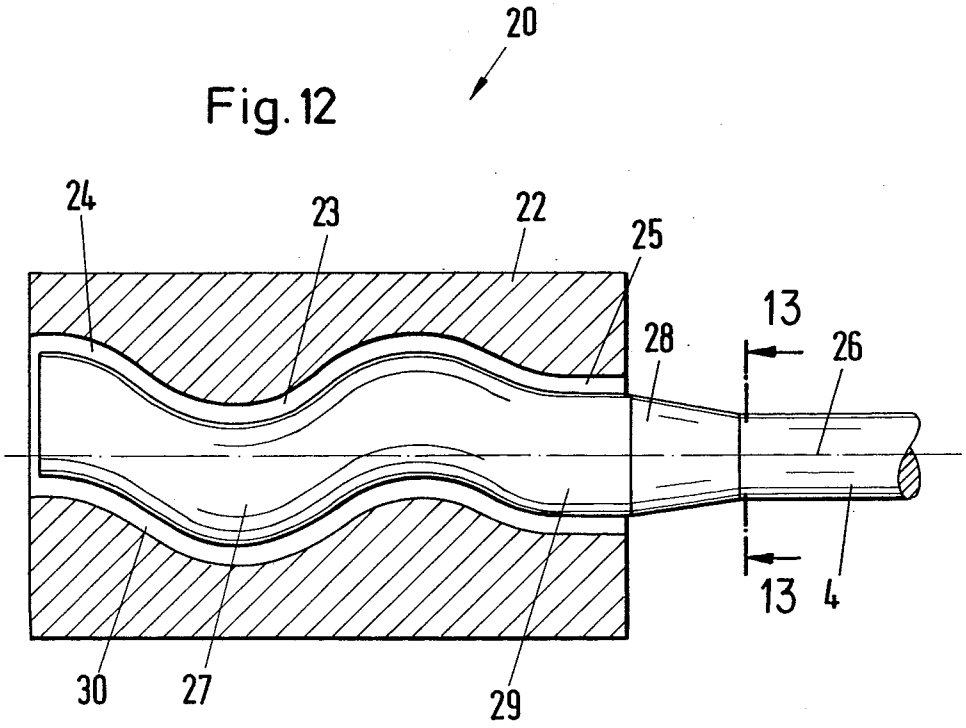
FIG. 12 shows a section corresponding to FIG. 10 through the die, but without pipe or spiral pipe.
Figure 13:
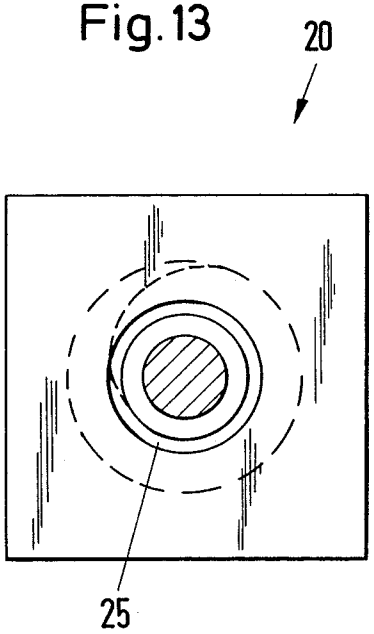
FIG. 13 shows a section along line XIII—XIII in FIG. 12.

In FIG. 9, an apparatus 19 for shaping pipes is shown. Those parts of the apparatus 19, which are identical with parts of the previous apparatus, have been given the same reference numbers. The apparatus 19 has a press frame 2 with various facilities for making adjustments and supporting dies. A press ram 3 can be moved forwards alongside a shaft 4, which is passed through the press ram 3 and anchored in the frame, in the direction of a die 20, with a force of up to about 1000 tons. The press ram 3 presses against a rearward face of a pipe section 6 (or also several such pipe sections strung sequentially on the shaft 4), to move this pipe section through the die 20. As can be seen from the drawing, the pipe sections 6, which are supplied to the die 20 in a cylindrical, straight form, leave the die 20 as spiral pipes 21 on the side facing away from the press ram 3.

The die 20 is shown in greater detail in FIGS. 10 to 13 on an enlarged scale. The die 20 comprises an outer die 22, with a horizontal through-hole 23 (compare FIG. 12). This forms the precise outside shape of the desired spiral pipe 21 at least in an end region 24 and preferably also in a middle region. On the other hand, an inlet region 25 of the through-hole 23 may be cylindrical or slightly helical, to facilitate entry. The cross section of the inlet region may also be overdimensioned, so that this slight funnel shape will facilitate entry of the pipe section 6.

In principle, the outer die 22 is suitable for pressing the pipe section supplied in the direction of an axis 26, from its cylindrical, straight unworked form into a spiral pipe with an extremely precise exterior shape. The exterior shape can also be designed so as to sustain high loads, by constructing it sufficiently large with externally applied material, narrow limits not being set for the dimensioning. Furthermore, an outer die can take up and dissipate much heat, so that the heat problems can be mastered relatively well—especially since the compressive load-carrying capability of the outer die in any case permits cold forming in regions, in which hot forming is generally preferred in other pipe-shaping processes.

The outer die 22 is supplemented by an inner die in the form of an expansion mandrel 27, which is adjacent to the continuous shaft 4. The latter is also suitable when only a deformation by the outer die 22 is intended, so as to guide the pipe section 6 cleanly to the die. The expansion mandrel 27 begins with an expansion zone 28 in the form of a conical stump, which is followed by a cylindrical or slightly helical section 29, which then ends in a concentric section in the spiral through-hole 24, so that it forms a precisely specified, uniform air gap 30 with the outer die. This air gap defines the wall thickness of the spiral pipe 21 that is being manufactured. At the same time, the spiral pipe is shaped smoothly and accurately at the outer as wall as at the inner surface. This deformation is initiated by expanding the pipe section 6 in the expansion zone 28 to the desired dimension. The additional shaping process can improve the strength of the pipe, but especially can eliminate tolerances of the pipe section 6.

Figure 14:
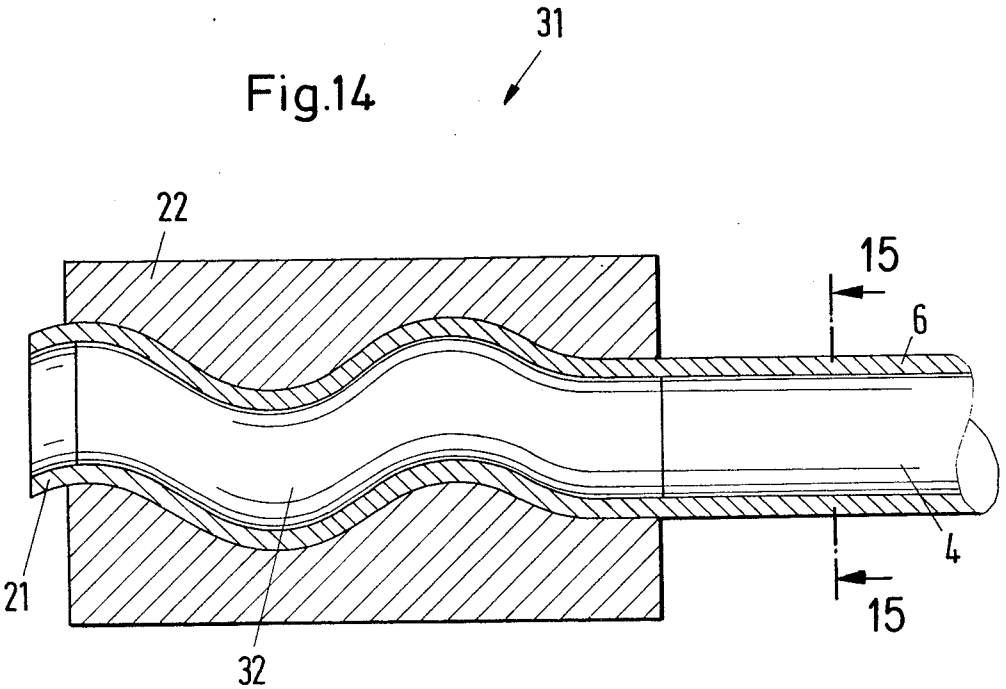
FIG. 14 shows a longitudinal section through a die according to a second embodiment.
Figure 15:
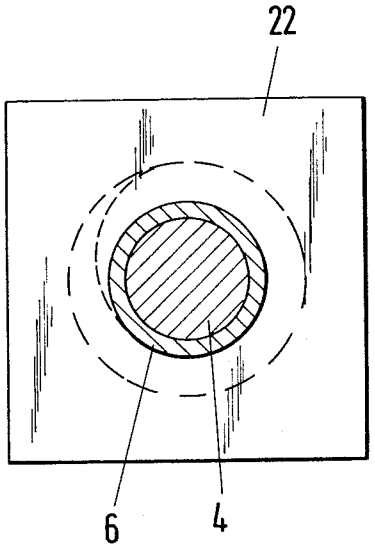
FIG. 15 shows a section along line XV—XV in FIG. 14.

Another embodiment of the die 31 of FIGS. 14 and 15 also makes use of an outer die and an inner die. The outer die is identical with that of FIGS. 10 and 15 and accordingly has the same reference number 22. A mandrel 32 serves as the inner die; however, it is designed not as an expansion mandrel but as a mandrel with a constant cross section. This mandrel does without any cross-sectional enlarging effect; instead, its cross section differs only slightly from that of the shaft 4, with which it makes flush contact. The mandrel 32 can be designed so that it becomes slightly larger from its shaft-side beginning to its free end, in order to effect a precise shaping of the inner wall of the spiral pipe 21. It can also be under-dimensioned all the way through with respect to the internal cross section of the pipe, so as to maintain clearance for movement. This limits the mandrel to the guidance task and leaves the process of shaping the pipe into spiral predominantly to the outer die.

The positive matching of the die with the spiral pipe produced therewith necessarily leads to a superimposed translational and rotational motion between the pipe and the die. Lest these motions be impaired, the press ram has a thrust bearing 8 for frontally accepting the pipe section which is contacting the press ram 8. Advisably, pressure transfer via internal rolling elements see to it that there is easy rotational mobility. Alternatively, it is also possible in principle forcibly to turn a rotatable pivot bearing synchronously with the advance motion, in order to force a matched infeed motion.

The pipe sections can be shaped both cold and hot. The pipe is suitably heated by a (not shown) heater directly before the outer die 22. Various heaters, for example, gas burners or inductive heaters, are available to those skilled in the art.

What we claim is:

1. A method of fabricating a spiral pipe for an eccentric spiral pump comprising axially advancing an elongated pipe over a die means consisting of a spiral die member having a cross-sectional diameter which is greater than one-half the overall outer diameter of said die means to thereby define a radial central solid die section which extends linearly along the longitudinal extent of said die member, and effecting relative rotation between said pipe and said die means as said pipe is axially advanced over said die means to thereby form a spiral pipe.

2. A method according to claim 1, wherein said relative rotation is effected by rotating said pipe.

3. A method according to claim 1, wherein said relative rotation is effected by rotating said die means.

4. A method according to claim 1, wherein said relative rotation between said pipe and said die means corresponds to the spiral pitch of said die means.

5. A method according to claim 1 further comprising heating at least a portion of the pipe being pressed over said die means.

6. A method according to claim 5, wherein said heating step comprises heating said pipe before said pipe is advanced over said die means.

7. A method according to claim 5, wherein said heating step comprises heating said pipe as said pipe is being advanced over said die means.

8. A method according to claim 1 further comprising forming said spiral on said pipe by pressing the outside of said pipe past an externally disposed die means.

9. A method according to claim 1, wherein said die means is formed as an elongated mandrel having a linear portion and a spiral portion, further comprising the steps of initially disposing a linear pipe over said linear portion of said mandrel, and subsequently pressing said pipe axially and effecting said relative rotation as said linear pipe is advanced from said linear portion to said spiral portion to thereby impart a spiral configuration to said pipe.

10. A method according to claim 1 comprising forming said spiral with a cross-sectional configuration selected from the group consisting of a circle, an oval and a polygon.

11. A method according to claim 1, wherein said spiral pipe has a cross-sectional diameter which is greater than one-half the overall outer diameter of said spiral pipe to thereby define a radially central internal passage which extends linearly and uninterrupted along the longitudinal length of said pipe.

12. A method according to claim 1, wherein said die means comprises internal and external spiral die members, further comprising the step of forming said spiral pipe by causing the advancing elongated pipe to engage the walls of both said internal and external die members to form said spiral pipe.

13. Apparatus for making a spiral pipe for an eccentric spiral pump comprising a press base structure having a press ram means moveable on said base structure, die means mounted on said base structure, said die means comprising a die member having a spiral configuration, said die member having a cross-sectional diameter which is greater than one-half the overall outer diameter of said die means to thereby define a radial central solid die section which extends linearly along the longitudinal extent of said die member, and operable means for moving said press ram means on said base structure to longitudinally advance a pipe past said die means while providing for relative rotation between said die means and said advancing pipe, thereby imparting a spiral configuration to said advancing pipe.

14. Apparatus according to claim 13, wherein said die means comprises an elongated mandrel having a linear portion and a spiral portion such that initially a linear pipe is disposed over said linear portion and then advanced longitudinally past said spiral portion by said press ram means.

15. Apparatus according to claim 13, wherein said operable means comprises a bearing means mounted on said press ram means and operably disposed between said pipe and said press ram means to provide for rotation of said pipe relative to said press ram means.

16. Apparatus according to claim 13, wherein said die means comprises an elongated mandrel having a linear portion and a spiral portion, said operable means providing for rotation of said mandrel as said pipe is advanced longitudinally past said spiral portion by said press ram means.

17. Apparatus according to claim 13, wherein said die means comprises an external spiral portion which engages the external wall of said pipe to impart to said advancing pipe a spiral configuration corresponding to the spiral configuration of said external spiral portion.

18. Apparatus according to claim 13, wherein said die means comprises an elongated mandrel having a linear portion and a spiral portion such that initially a linear pipe is disposed over said linear portion and then advanced longitudinally over said spiral portion by said press ram means, said die means further comprising an external spiral die which engages the external wall of said pipe as the latter is advanced by said press ram means.

19. Apparatus according to claim 18, wherein said external spiral die is disposed radially outwardly of said spiral portion such that the advancing pipe passes between said external spiral die and said spiral portion.

20. Apparatus according to claim 13, wherein said spiral pipe has a cross-sectional diameter which is greater than one-half the overall outer diameter of said spiral pipe to thereby define a radially central internal passage which extends linearly and uninterrupted along the longitudinal length of said pipe.

21. Apparatus according to claim 13, wherein said die member is an internal die member, said die means further comprising an external spiral die member disposed about said internal die member and spaced from said internal die member by a distance corresponding to the wall thickness of the spiral pipe made by said die means.

22. Apparatus according to claim 13, wherein said die member is an internal die member, said die means further comprising an external spiral die member disposed about said internal die member and spaced from said internal die member by a distance greater than the wall thickness of the spiral pipe made by said die means, said spiral pipe being formed by engagement with said external die member.

* * * * *